US009931874B2

(12) United States Patent
Paulson et al.

(10) Patent No.: US 9,931,874 B2
(45) Date of Patent: Apr. 3, 2018

(54) RIBBON SUPPLY MOUNTING

(71) Applicant: Entrust Datacard Corporation, Shakopee, MN (US)

(72) Inventors: Arthur J. Paulson, Shakopee, MN (US); James A. Kalthoff, Shakopee, MN (US); Alexander K. Zaborowski, Shakopee, MN (US); Bryan D. Hoeve, Shakopee, MN (US)

(73) Assignee: ENTRUST DATACARD CORPORATION, Shakopee, MN (US)

( * ) Notice: Subject to any disclaimer, the term of this patent is extended or adjusted under 35 U.S.C. 154(b) by 0 days.

(21) Appl. No.: 15/349,719

(22) Filed: Nov. 11, 2016

(65) Prior Publication Data

US 2017/0136795 A1 May 18, 2017

Related U.S. Application Data

(60) Provisional application No. 62/255,107, filed on Nov. 13, 2015.

(51) Int. Cl.

| | |
|---|---|
| ***B41J 33/16*** | (2006.01) |
| ***B65H 75/10*** | (2006.01) |
| ***B65H 75/18*** | (2006.01) |

(52) U.S. Cl.

CPC ..... *B41J 33/16* (2013.01); *B65H 75/10* (2013.01); *B65H 75/185* (2013.01)

(58) Field of Classification Search

CPC ..... B41J 15/046; B41J 15/044; B41J 15/04; B41J 15/00; B41J 33/16; B41J 13/0009; B41J 13/00; B65H 75/185; B65H 75/10

See application file for complete search history.

(56) References Cited

U.S. PATENT DOCUMENTS 6,726,144 B2 4/2004 Squires
6,997,629 B2 2/2006 Bungert et al.
(Continued)

FOREIGN PATENT DOCUMENTS

WO 2011109456 9/2011

OTHER PUBLICATIONS

International Search Report and Written Opinion of International Application No. PCT/US2016/061632, dated Feb. 16, 2017, total 20 pages.

(Continued)

*Primary Examiner* — Kristal Feggins
(74) *Attorney, Agent, or Firm* — Hamre, Schumann, Mueller & Larson, P.C.

(57) ABSTRACT

A mounting of a ribbon supply on a re-useable cartridge is described where the mounting is designed so that the supply friction, supply and control of the ribbon supply are substantially independent of the cartridge. When the supply rolls are initially mounted on the cartridge, the supply rolls are frictionally engaged with the cartridge to reduce the tendency for the supply rolls to rotate or move prior to being loaded into the printer, which would loosen the ribbon material by unwinding, thereby reducing slack in the ribbon material. When the cartridge is loaded into a card personalization machine, features on the card personalization machine automatically reduce the frictional engagement between the supply rolls and the cartridge, permitting the supply rolls to rotate substantially freely relative to the cartridge so that the supply friction, supply and control are substantially independent of the cartridge.

17 Claims, 18 Drawing Sheets

(56) References Cited

U.S. PATENT DOCUMENTS

| | | | |
|---|---|---|---|
| 7,434,728 | B2 | 10/2008 | Paulson et al. |
| 9,550,380 | B2 | 1/2017 | Balcan et al. |
| 2004/0109715 | A1 | 6/2004 | Meier et al. |
| 2005/0275708 | A1 | 12/2005 | Squires et al. |
| 2007/0086823 | A1 | 4/2007 | Lodwig et al. |
| 2008/0236761 | A1 | 10/2008 | Meier et al. |

OTHER PUBLICATIONS

Photographs showing a roll cap used by Entrust Datacard Corporation prior to Nov. 13, 2015, 3 pages.

RIBBON SUPPLY MOUNTING

FIELD

This technical disclosure relates to ribbon supplies that can be used in a number of applications, including card personalization machines such as desktop card personalization machines.

BACKGROUND

The use of ribbon supplies in card personalization machines is well known. In some instances, the ribbon supplies are mounted on a cartridge that is removably installed into the card personalization machine. When the ribbon supply needs to be replaced, the end user removes the cartridge, removes the used ribbon supply from the cartridge, installs a new ribbon supply on the cartridge, and the user then reinserts the cartridge into the card personalization machine. Examples of cartridges and ribbon supplies are disclosed in U.S. Pat. Nos. 6,997,629 and 7,434,728.

Replacement of the ribbon supply of a card personalization machine is often performed by personnel for whom generating personalized cards is only an incidental portion of their job, such as a security guard or a desk clerk, and not by personnel who have special training in such equipment. Therefore, the replacement of the ribbon supply should be made to be relatively intuitive and straightforward.

SUMMARY

A mounting of a ribbon supply on a re-useable cartridge is described where the mounting is designed so that the supply friction, supply and control of the ribbon supply are substantially independent of the cartridge. When the supply rolls are initially mounted on the cartridge, the supply rolls are frictionally engaged with the cartridge to reduce the tendency for the supply rolls to rotate or move prior to being loaded into the printer, which would loosen the ribbon material by unwinding, thereby reducing slack in the ribbon material. When the cartridge is loaded into a card personalization machine, features on the card personalization machine automatically reduces the frictional engagement between the supply rolls and the cartridge, permitting the supply rolls to rotate substantially freely relative to the cartridge so that the supply friction, supply and control are substantially independent of the cartridge. If the frictional engagement was not substantially removed, the cartridge would act as a friction drag clutch. However, friction drag clutches have an unacceptable high variation in drag friction, making it difficult to control wind and unwind tension on the ribbon material.

The ribbon supply can be any ribbon supply used in a card personalization machine, including desktop card personalization machines and central issuance card personalization systems. Examples of ribbon supplies include, but are not limited to, print ribbon supplies, retransfer films, laminate ribbons, topcoat ribbons, cleaning ribbons, embossed character tipping foils, indent foils, and other consumable supplies that have a ribbon-like material that is initially wound on a supply spool and during use the ribbon is wound onto a take-up spool. In the case of print ribbon supplies, the print ribbon can be monochromatic (i.e. single color) ribbon or ribbon with multiple discrete color panels, for example a YMCK print ribbon containing yellow, magenta, cyan and black panels.

In the mounting described herein, a cap is configured to be mounted to the end of the supply spool and/or the take-up spool of the ribbon supply. In one embodiment, the cap can be removably mounted to the end of the spool. The ribbon supply is mountable onto a cartridge that is removably installable into a card personalization machine. When the ribbon supply is mounted on the cartridge, the cap is designed to frictionally engage with the cartridge in a manner to hold the respective spool in place and reduce the tendency for the respective spool to rotate. When the cartridge is installed in the card personalization machine, a feature on the machine engages with the cap and/or the spool to substantially reduce the frictional engagement, thereby permitting the supply rolls to rotate substantially freely relative to the cartridge during use of the ribbon supply in the card personalization machine.

In one embodiment, a roll cap that is mountable at an end of a spool of a roll of a ribbon supply includes a cap body having a first end, a second end opposite the first end, and a central axis extending from the first end to the second end. The cap also includes a neck that extends from the first end toward the second end and that is sized to fit into the end of the spool. A first flange is formed on the cap body at an end of the neck, and the first flange is positioned between the neck and the second end. In addition, a second flange is formed on the cap body at a position so that the first flange is between the neck and the second flange. The first flange and the second flange define a channel therebetween. A protrusion projects from the second end of the cap body in a direction away from the first end, and the protrusion is located on the second end so that the central axis extends through the protrusion.

In another embodiment, a ribbon supply includes a ribbon supply roll and a ribbon take-up roll, each of the ribbon supply roll and the ribbon take-up roll has a spool with a first end and a second end. One of the roll caps described herein is mounted at either the first end or the second end of at least one of the spools. In one embodiment, a roll cap is mounted at the end of the spool of the ribbon supply roll. In another embodiment, a roll cap is mounted at the end of the spool of the ribbon take-up roll. In still another embodiment, there is a roll cap mounted at the end of the spool of the ribbon supply roll and a roll cap is mounted at the end of the spool of the ribbon take-up roll.

DRAWINGS

Figures 3A, 3B, 3C:
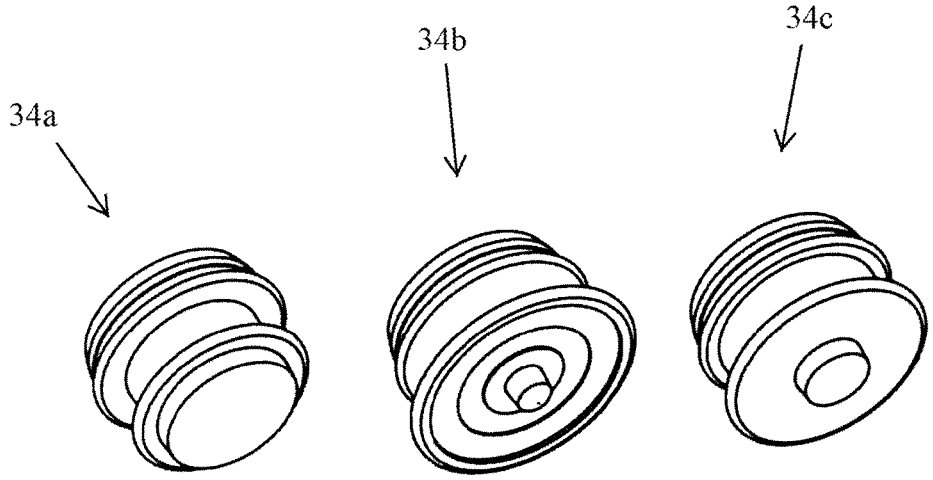

FIGS. 3A-C illustrate different embodiments of roll caps that can be installed in ends of the supply rolls described herein.

FIGS. 4A-D are side cross-sectional, side, end and top views, respectively, of the roll cap in FIG. 3A that can be used with a first type of supply roll.

FIGS. 5A-D are side cross-sectional, side, end and top views, respectively, of the roll cap of FIG. 3B that can be used with a second type of supply roll.

FIGS. 6A-D are side cross-sectional, side, end and top views, respectively, of the roll cap of FIG. 3C that can be used with a third type of supply roll.

Figure 7:
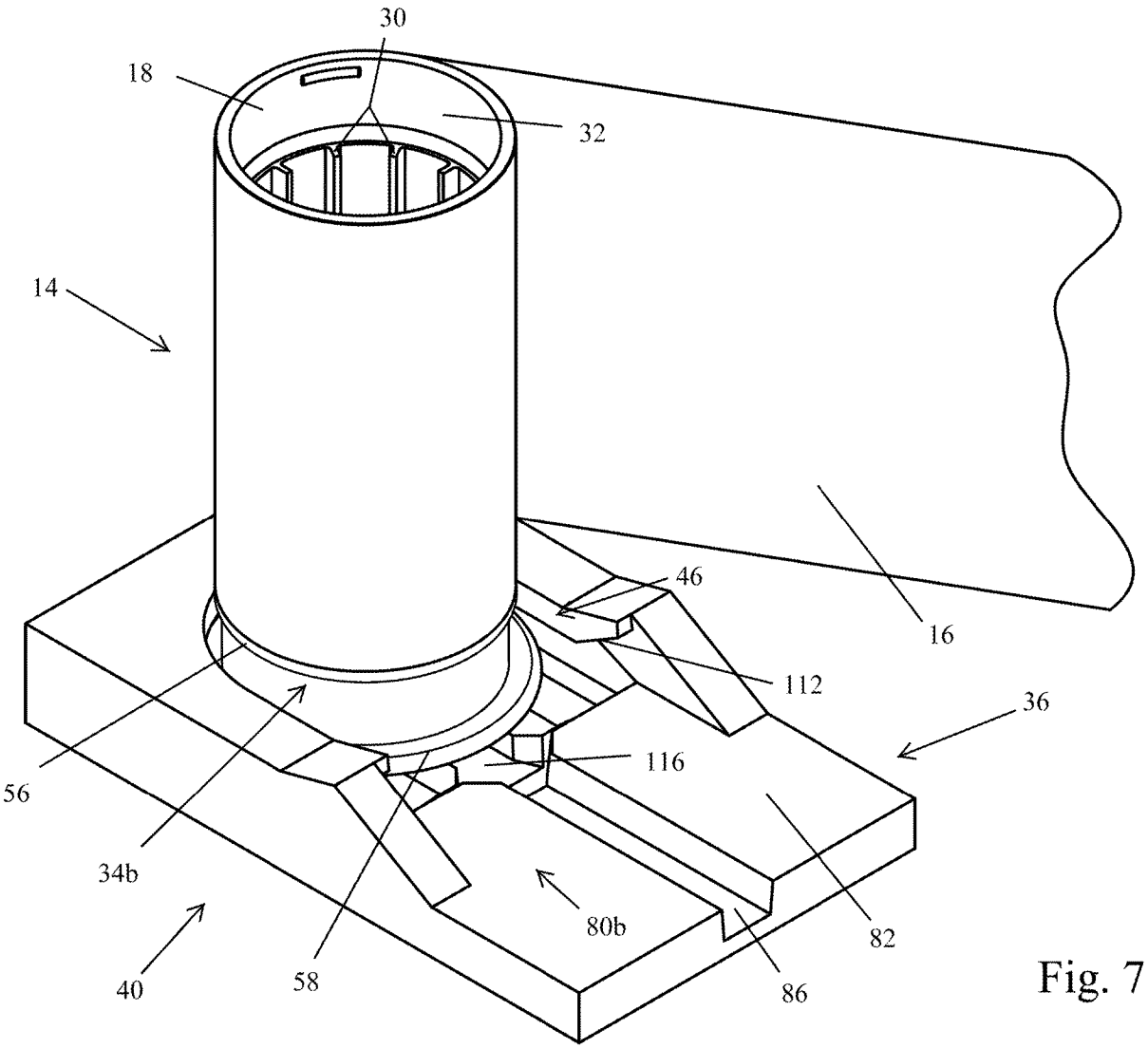

FIG. 7 illustrates one of the supply rolls with a roll cap installed in one end of the supply roll and mounted on another embodiment of a cartridge.

Figure 8:
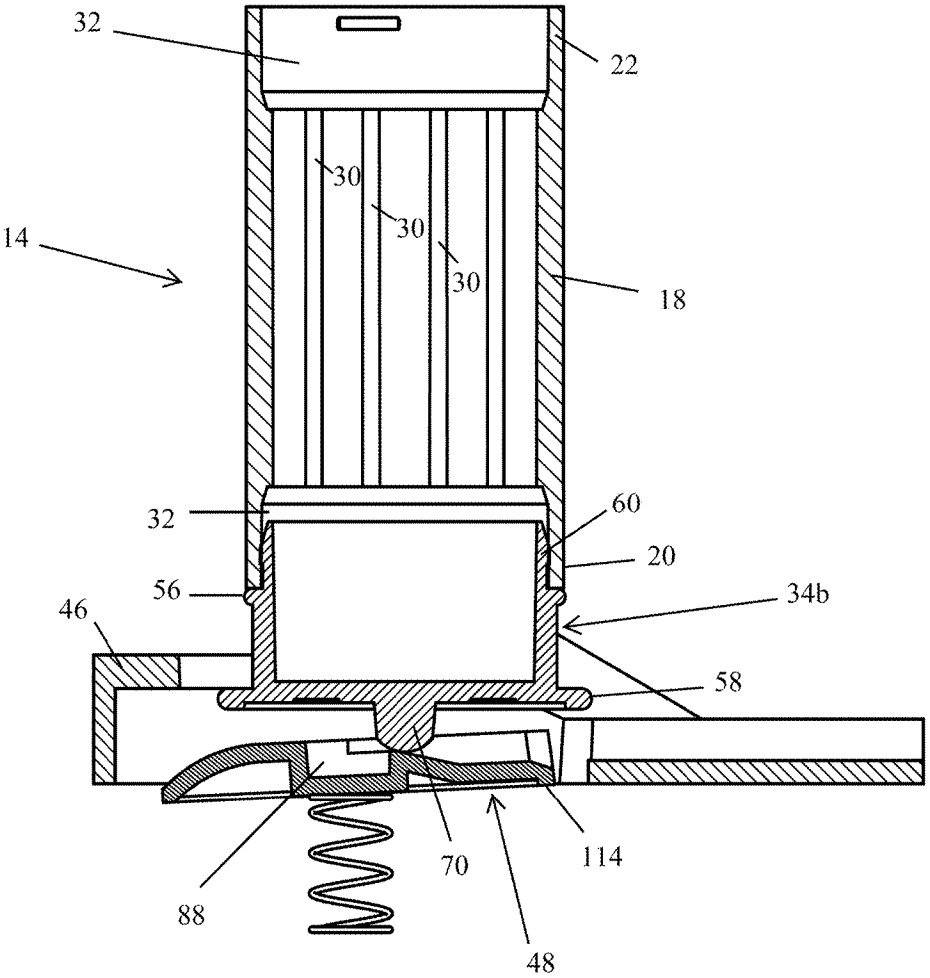

FIG. 8 is a cross-sectional side view showing the supply roll in an initial stage of installation on the cartridge of FIG. 7.

Figure 9:
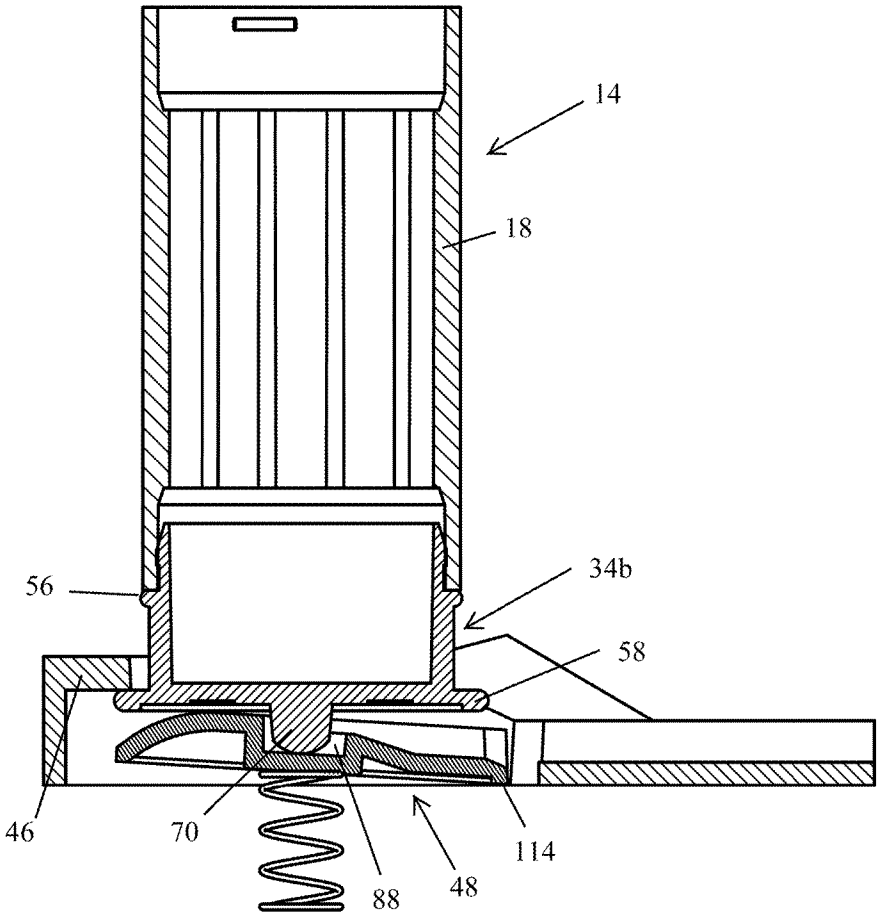

FIG. 9 is a cross-sectional side view similar to FIG. 8 but showing the supply roll fully installed on the cartridge.

Figure 10:
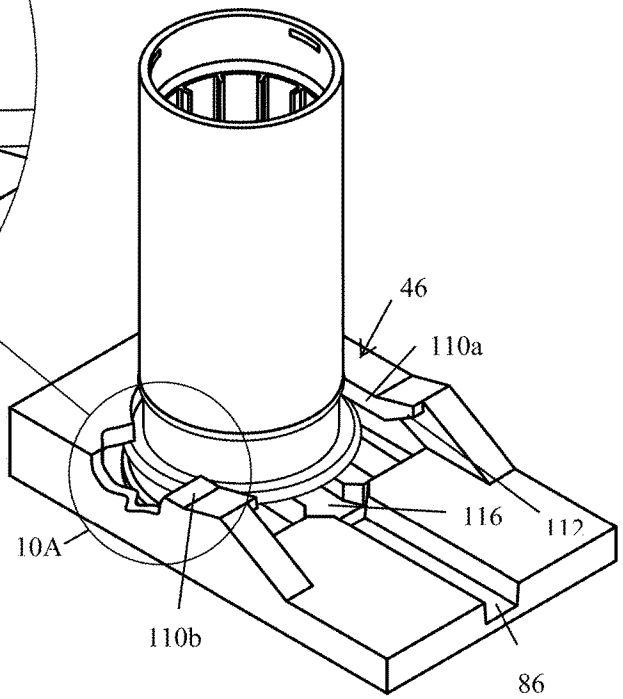

FIG. 10 is a perspective view of the supply roll installed on the cartridge.

Figure 10A:
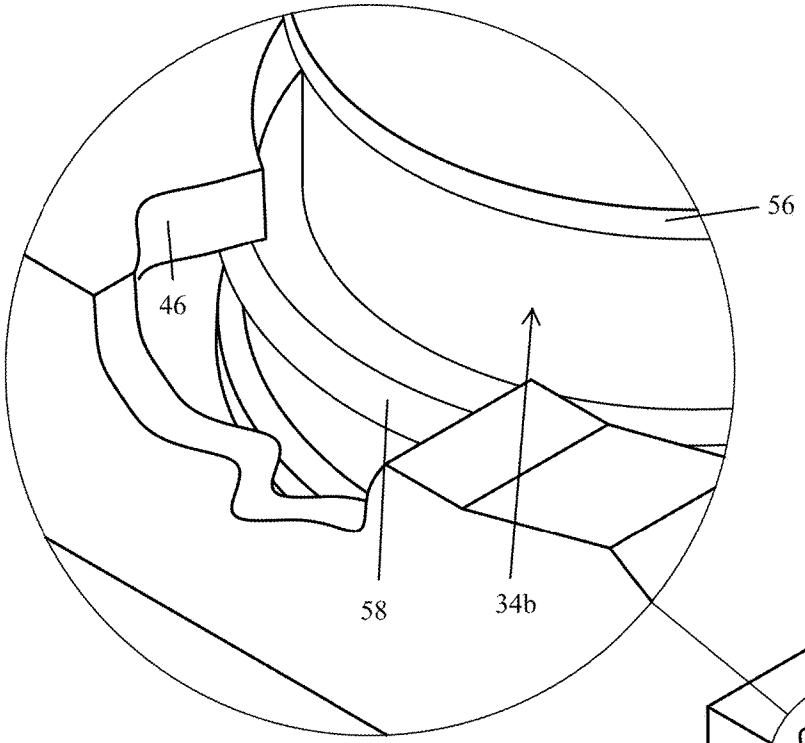

FIG. 10A is a detailed view of the portion contained in the circle 10A of FIG. 10.

Figure 11:
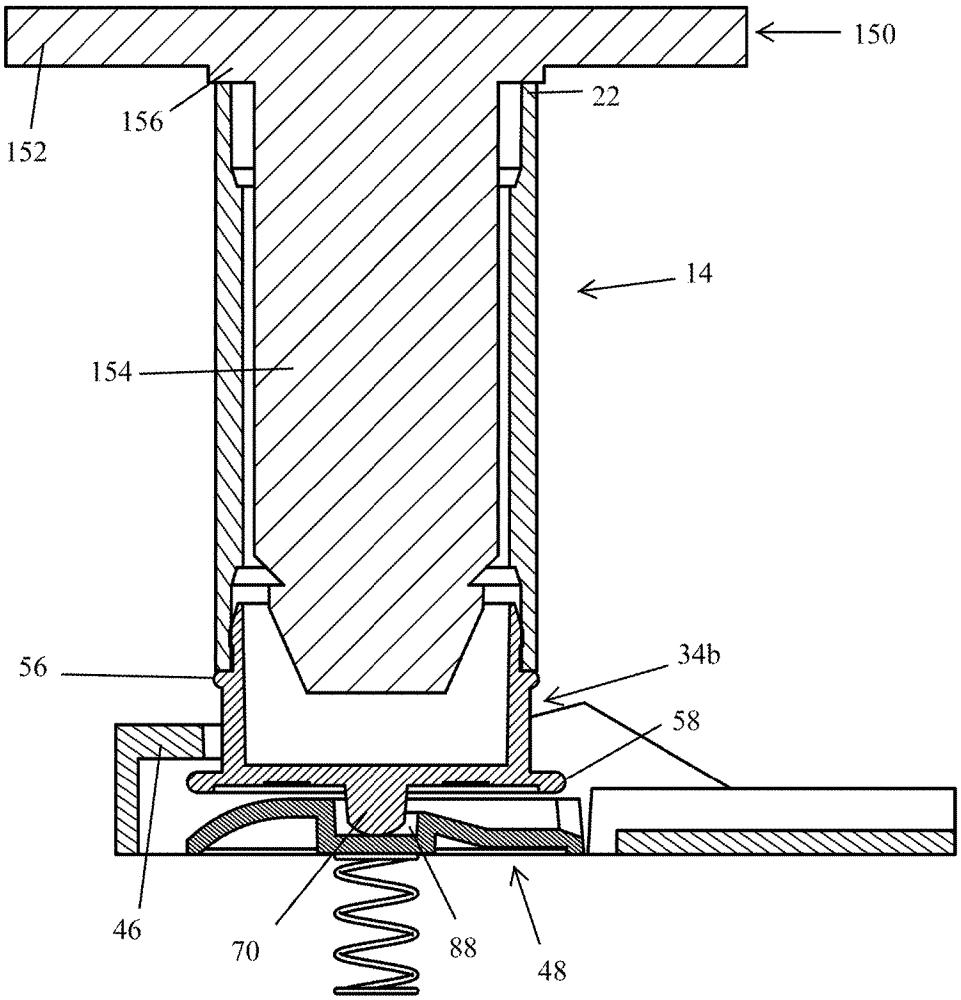

FIG. 11 is a cross sectional view of the supply roll when it is mounted within a card personalization machine and the supply roll is forced to a seated position relative to the cartridge.

Figure 2A:
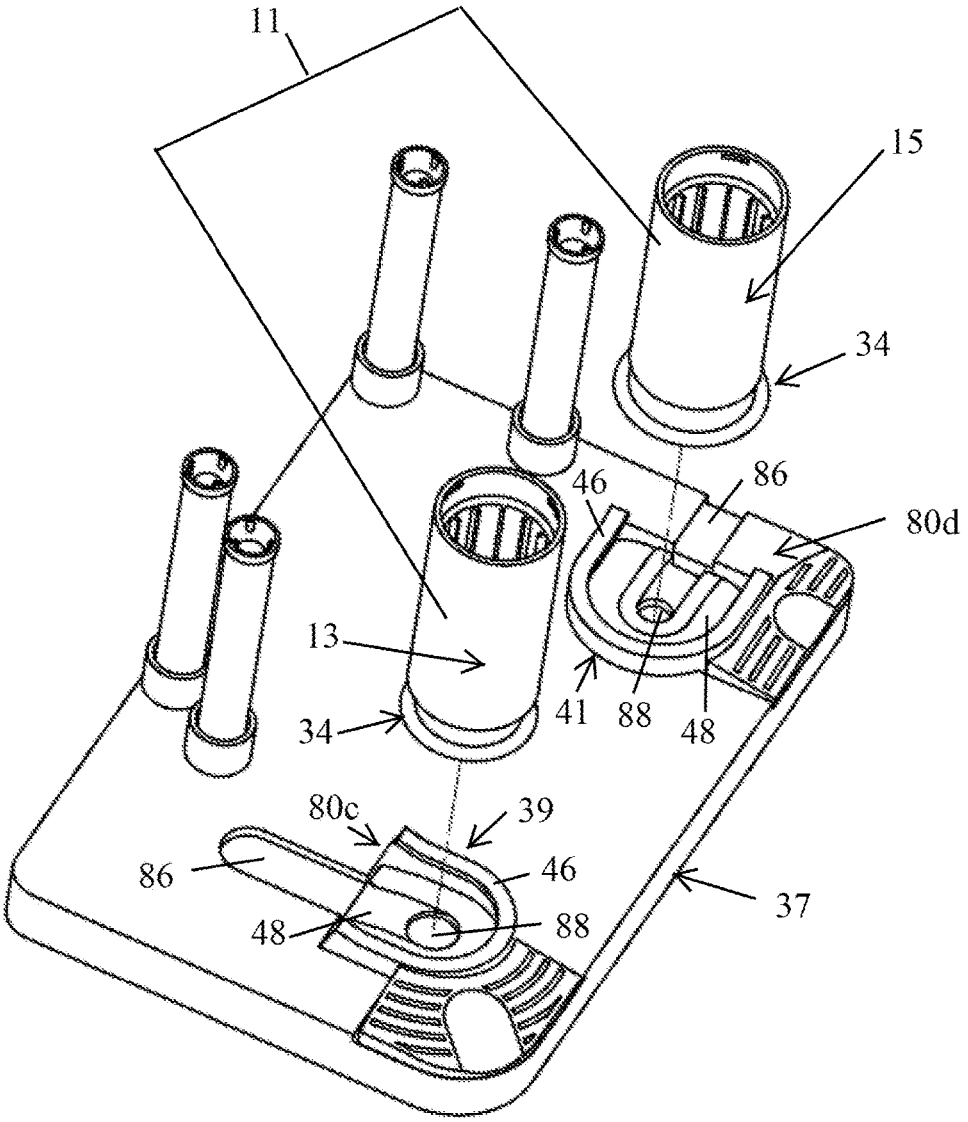
FIG. 2A is a perspective view of another embodiment of supply rolls including a ribbon supply roll and a ribbon take-up roll of a ribbon supply, in particular a retransfer film supply, described herein, with the ribbon supply positioned to be installed on another embodiment of a cartridge described herein.
Figure 2B:
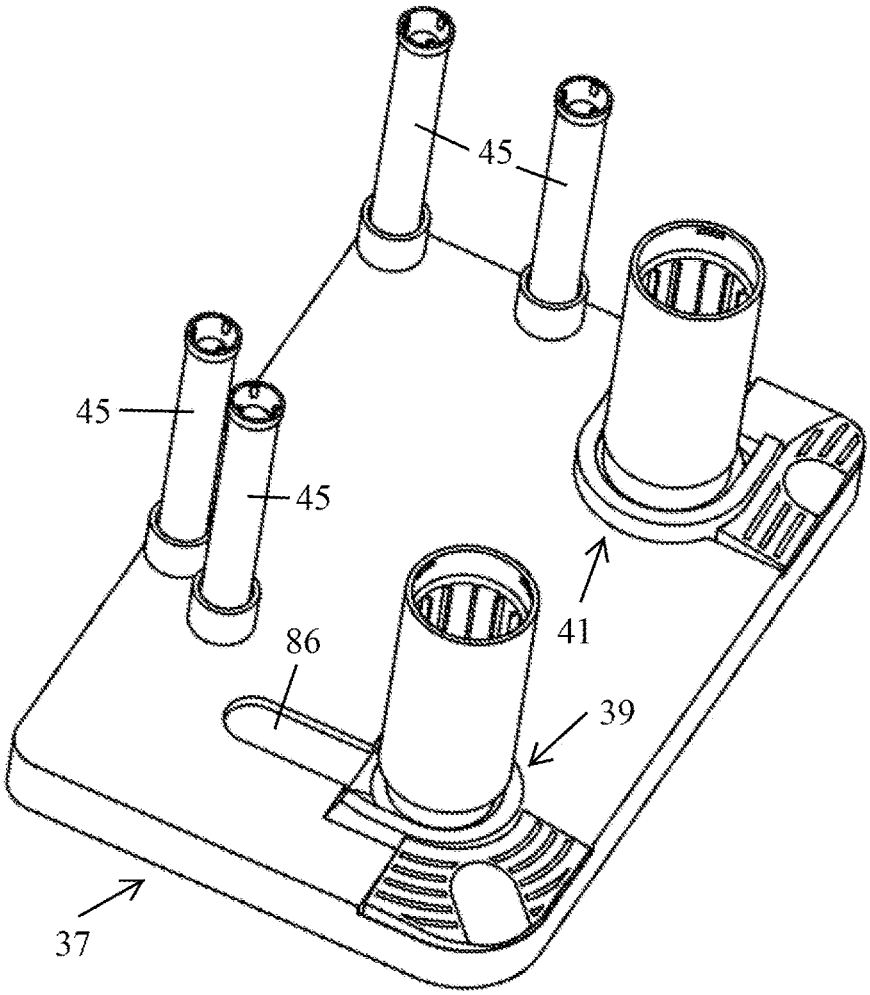
FIG. 2B is a perspective view of the supply rolls of FIG. 2A mounted on the cartridge.
Figure 12:
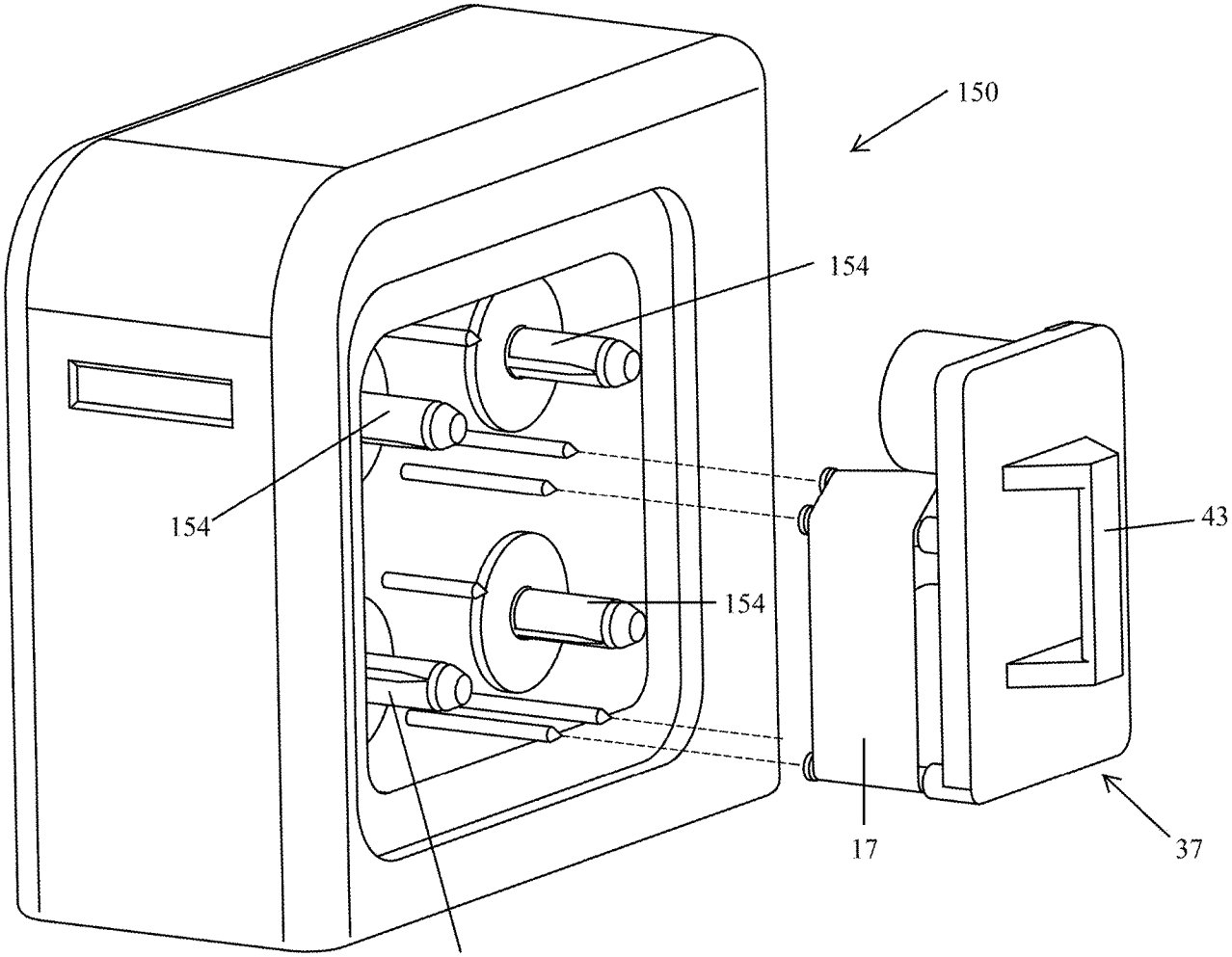

FIG. 12 is a perspective view of a card personalization machine with the cartridge of FIGS. 2A and 2B about to be loaded into the machine.

Figure 13:
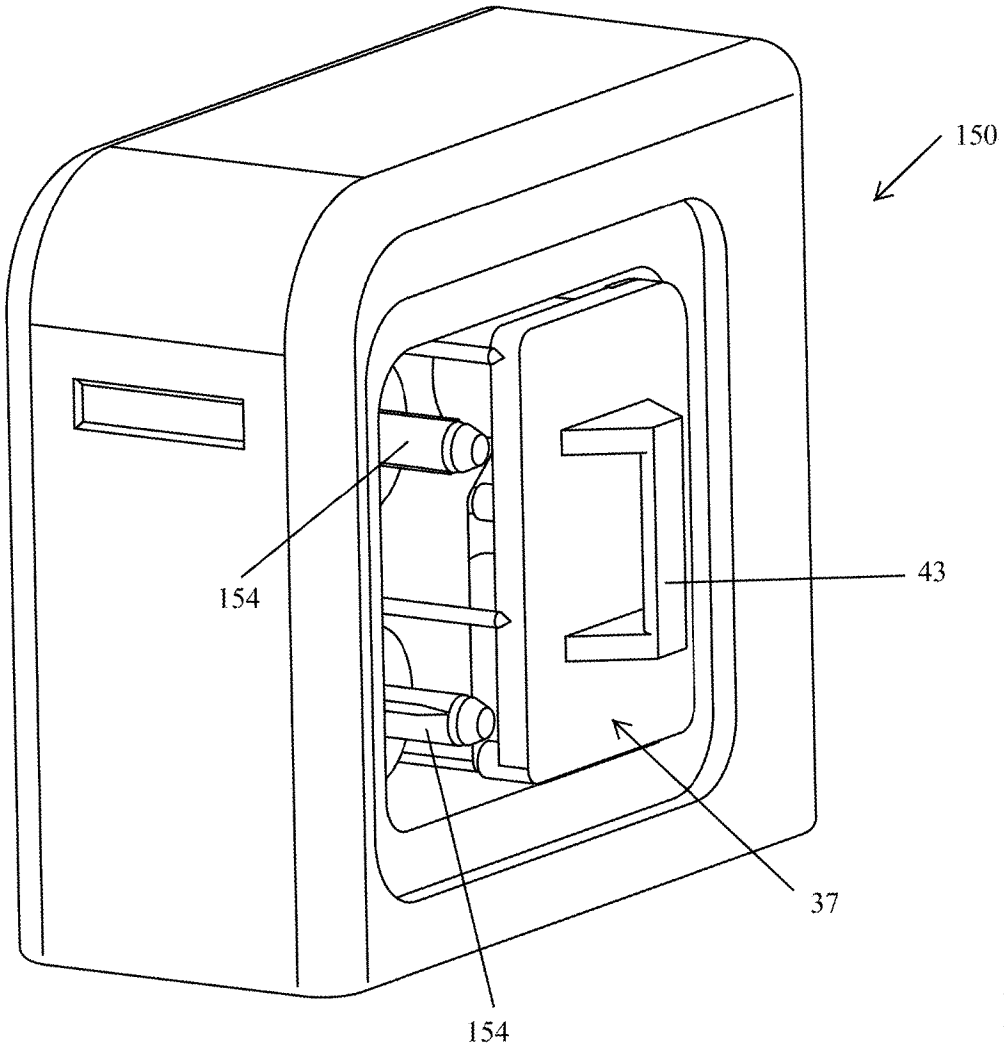

FIG. 13 is a perspective view of the card personalization machine with the cartridge of FIGS. 2A and 2B loaded into the machine.

Figure 1A:
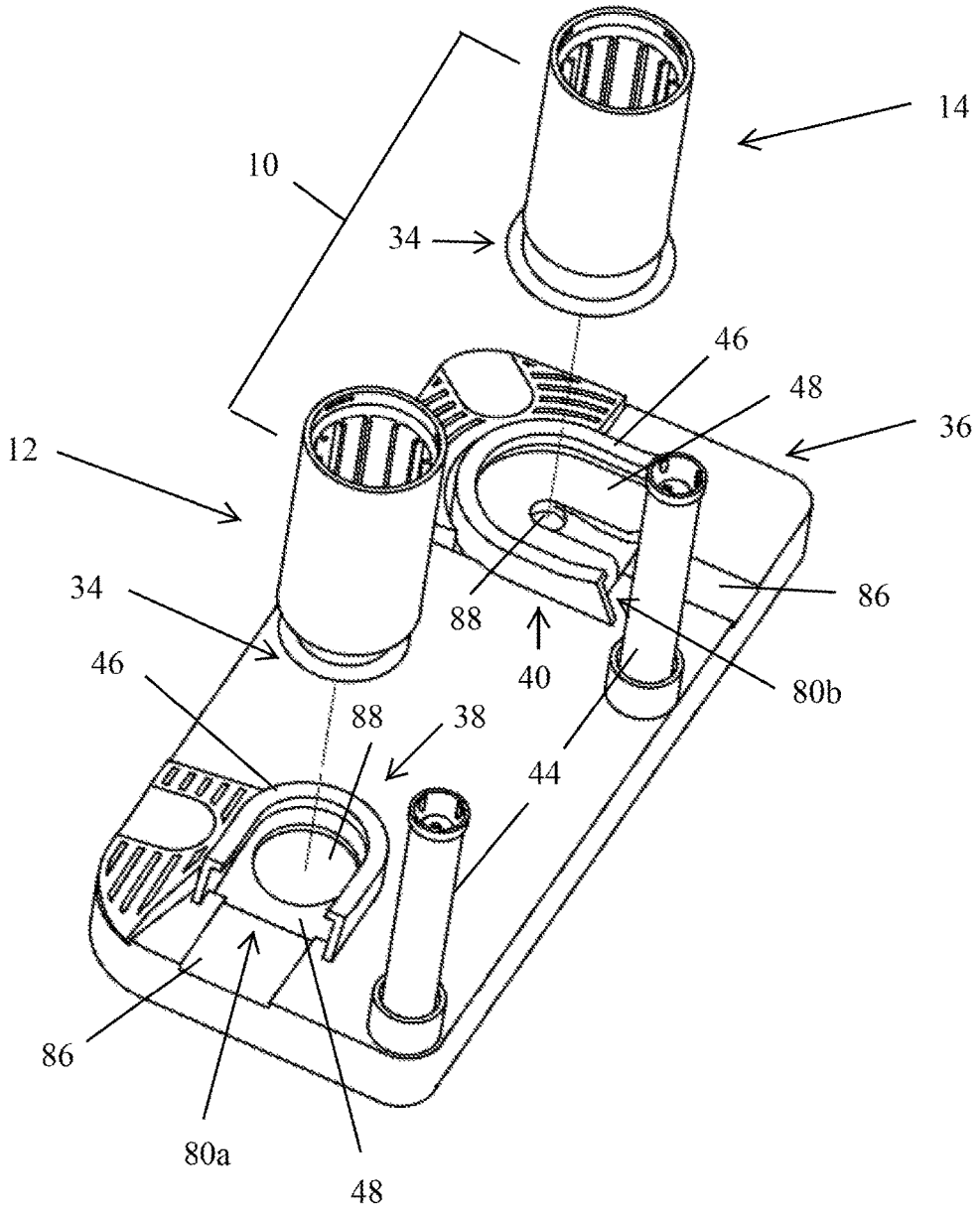
FIG. 1A is a perspective view of supply rolls including a ribbon supply roll and a ribbon take-up roll of a ribbon supply, in particular a print ribbon supply, described herein, with the ribbon supply positioned to be installed on one embodiment of a cartridge described herein.
Figure 1B:
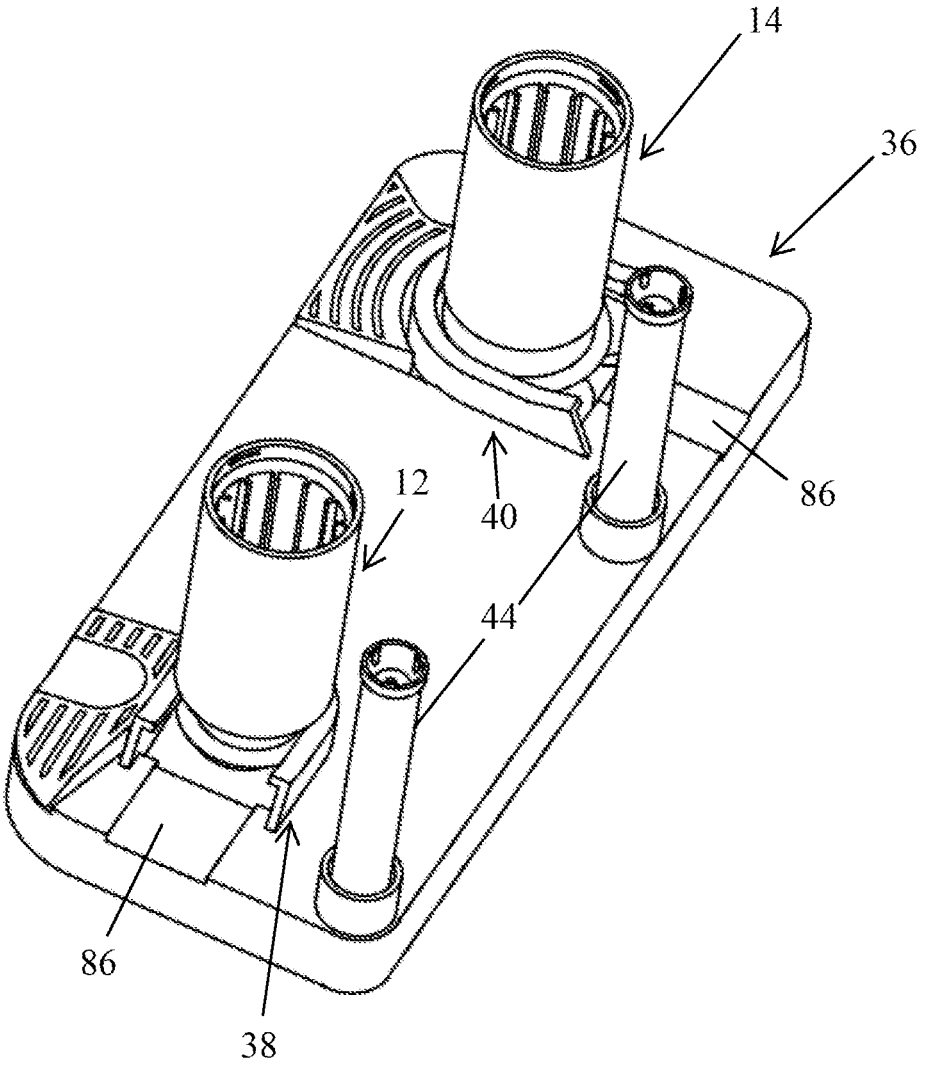
FIG. 1B is a perspective view of the supply rolls of FIG. 1A mounted on the cartridge.
Figure 14:
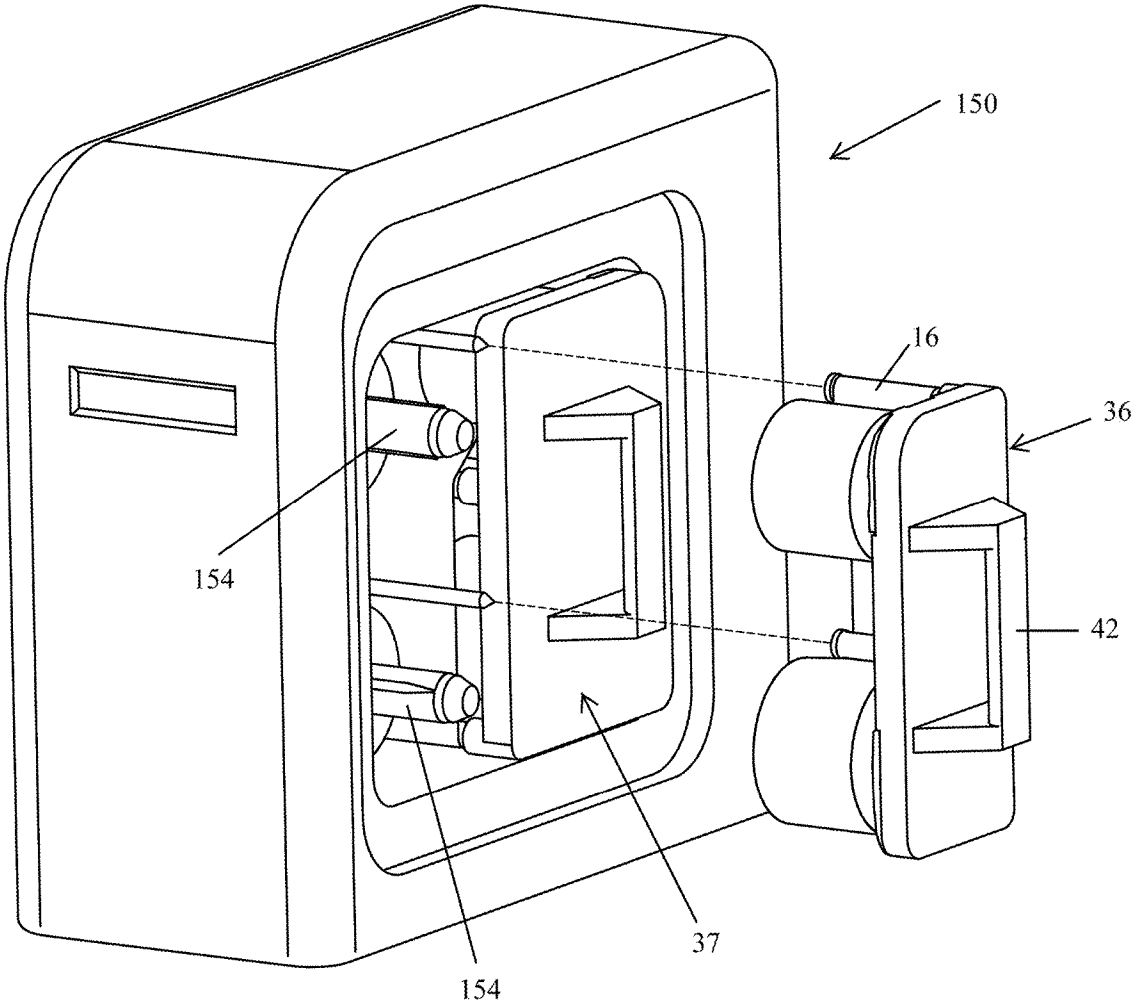

FIG. 14 is a perspective view of the card personalization machine with the cartridge of FIGS. 1A and 1B about to be loaded into the machine.

Figure 15:
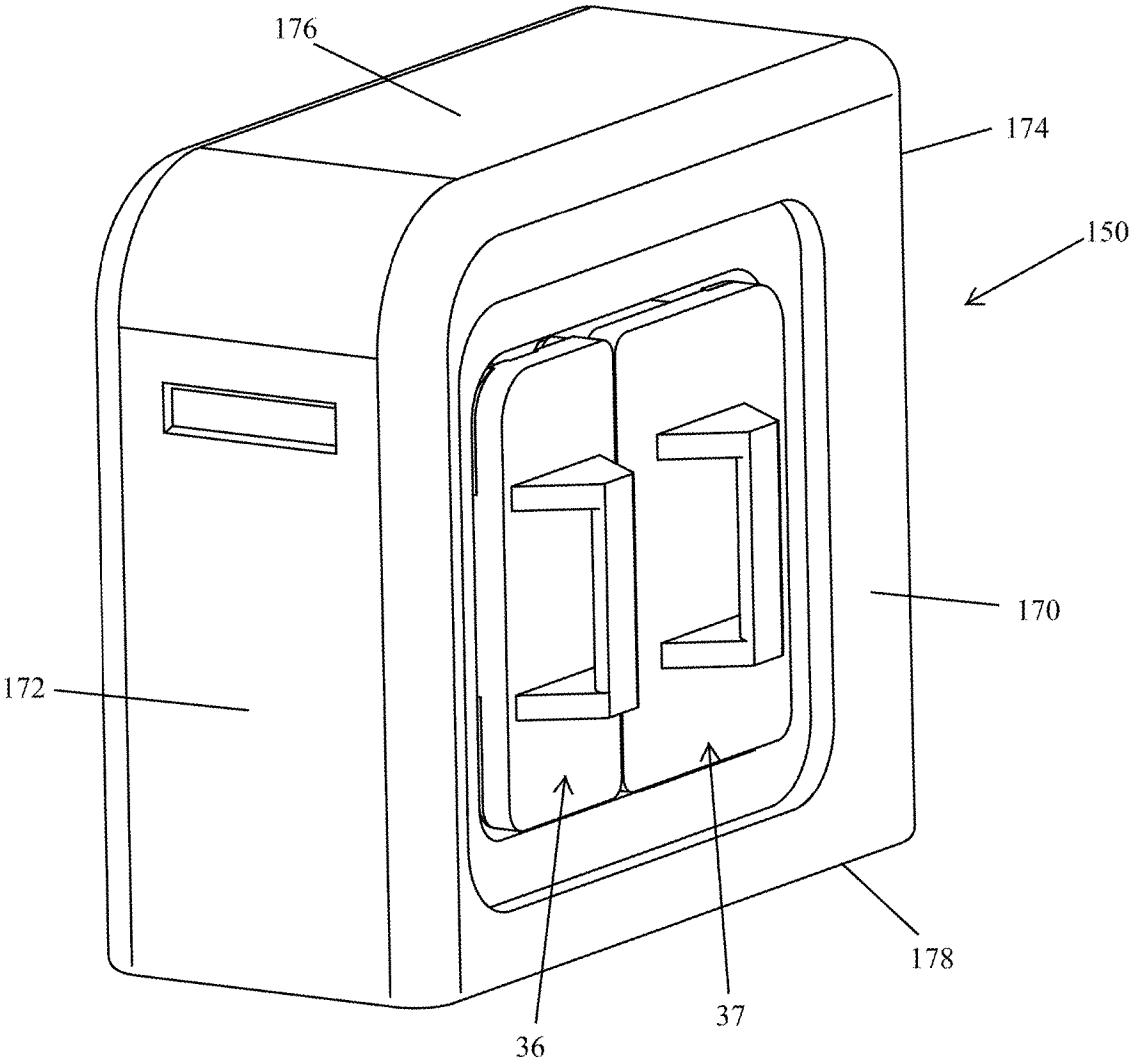

FIG. 15 is a perspective view of the card personalization machine with the cartridge of FIGS. 1A and 1B loaded into the machine.

DETAILED DESCRIPTION

A ribbon supply as used throughout this application, including the claims, unless otherwise defined, includes at least a ribbon supply roll that supplies a consumable ribbon-like material to be used, and optionally a ribbon take-up roll upon which the ribbon-like material is wound after the ribbon-like material is used. Each of the ribbon supply roll and the ribbon take-up roll can be referred to individually as a supply roll or simply a roll of the ribbon supply.

Each of the ribbon supply roll and the ribbon take-up roll has a spool. In the case of the ribbon supply roll, the spool may be referred to as a supply spool. In the case of the ribbon take-up roll, the spool may be referred to as a take-up spool. A consumable ribbon-like material is wound onto the supply spool. During use of the ribbon supply, the ribbon-like material is wound onto (i.e. taken-up on) the take-up spool. Prior to use, an end of the ribbon-like material may be pre-attached, directly or indirectly, in any suitable manner to the take-up spool eliminating the need for the end user to attach the end to the take-up spool. In another embodiment, the end of the ribbon-like material may not be pre-attached to the take-up spool and the end user is required to attach the end, directly or indirectly, to the take-up spool prior to use. In either event, at some point prior to the ribbon supply being loaded into a machine for use, the end of the ribbon-like material is attached, directly or indirectly, to the take-up spool so that the ribbon-like material can be wound up (i.e. taken up) on the take-up spool.

The ribbon supply is configured to be removably mounted onto a re-usable cartridge that is removably installable into a machine in which the ribbon supply is to be used. When the ribbon supply needs to be replaced, the re-useable cartridge can be removed from the machine. The supply rolls can be then be removed from the cartridge and a new ribbon supply mounted onto the cartridge. The cartridge can then be reinstalled into the machine.

The ribbon supply can be any type of ribbon supply that is mountable onto a re-useable cartridge that is removably installable for use in any type of machine that uses such a re-useable cartridge. In one embodiment, the ribbon supply is for use in a card personalization machine that is designed to personalize one or more plastic cards including, but not limited to financial (e.g., credit, debit, or the like) cards, driver's licenses, national identification cards, business identification cards, gift cards, and other plastic cards which bear personalized data unique to the cardholder and/or which bear other card information. In some embodiments, the ribbon supply may be used to personalize passports or other non-card-like documents which may also be personalized in a machine that can generally be referred to as a card personalization machine. The card personalization machine can be a desktop card personalization machine that is designed to personalize cards one at a time, for example on the order of tens or hundreds per hour, or a central issuance system that is designed to simultaneously personalize multiple cards, for example on the order of thousands per hour. For sake of convenience, the machine will be described as being a card personalization machine that is intended to encompass a machine that personalizes cards as well as passports and other identification documents.

The ribbon-like material can be any ribbon-like material that is consumed or used, and that from time-to-time needs replacement. Examples of ribbon-like materials include, but are not limited to, print ribbons, retransfer films, laminate ribbons, topcoat ribbons, cleaning ribbons, embossed character tipping foils, indent foils, and other consumable supplies that have a ribbon-like material that is initially wound on a supply spool and during use the ribbon is wound onto a take-up spool. In the case of a print ribbon, the print ribbon can be a monochromatic (i.e. single color) ribbon or a ribbon with multiple discrete color panels, for example a YMCK print ribbon containing yellow, magenta, cyan and black panels.

Referring initially to FIGS. 1A and 1B, a ribbon supply 10 is illustrated. The ribbon supply 10 includes a ribbon supply roll 12, a ribbon take-up roll 14, and a ribbon-like material 16 (shown in FIGS. 7 and 14). In this embodiment, the ribbon supply 10 can be a print ribbon supply where the ribbon-like material 16 is a print ribbon. The ribbon supply 10 is configured to be removably mounted onto a re-useable cartridge 36 that can be removably installed into and removed from a card personalization machine 150 (best seen in FIGS. 14 and 15). To facilitate installation and removal, the cartridge 36 can include a handle 42 (FIGS. 14 and 15) that can be grasped by a user during removal and insertion of the cartridge 36 into the card personalization machine 150 (FIGS. 14 and 15).

FIGS. 2A and 2B illustrate another example of a ribbon supply 11 that includes a ribbon supply roll 13, a ribbon take-up roll 15, and a ribbon-like material 17 (shown in FIG. 12). In this embodiment, the ribbon supply 11 can be a retransfer film supply where the ribbon-like material 17 is a retransfer film upon which an image can be printed, and then the printed image can be transferred from the retransfer film onto the substrate, such as a card or passport. The ribbon supply 11 is configured to be removably mounted onto a re-useable cartridge 37 that can be removably installed into and removed from the card personalization machine 150 (best seen in FIGS. 12 and 13). To facilitate installation and removal, the cartridge 37 can include a handle 43 (FIGS. 12 and 13) that can be grasped by a user during removal and insertion of the cartridge 37 into the card personalization machine 150 (FIGS. 12 and 13).

Referring to FIG. 15, when both of the cartridges 36, 37 are installed in the card personalization machine 150, the cartridges 36, 37 are arranged side-by-side with one another, supplying the respective print ribbon 16 and retransfer film 17 for use in a retransfer printing operation. However, the concepts described herein are not limited to retransfer printing, and can be applied to any individual ribbon supply used in a card personalization machine. In FIG. 15, the cartridges 36, 37 are installed through a side 170 of the machine 150. The machine 150 also includes a front side 172 through which cards (or passports) can be input and output from the machine 150, a rear side 174, a top side 176, and a bottom side 178.

The cartridges 36, 37 are each designed to mount the rolls 12-15 of their respective ribbon supply 10, 11 in a generally similar manner. When the rolls 12-15 are initially mounted on the respective cartridge 36, 27, the rolls are frictionally engaged with the cartridge to reduce the tendency for the rolls to rotate or move prior to being loaded into the machine 150, which would loosen the ribbon material by unwinding, thereby reducing slack in the ribbon material. When the cartridges 36, 37 are loaded into the card personalization machine 150, features on the card personalization machine 150 automatically reduce the frictional engagement between the rolls 12-15 and the cartridges 36, 37, permitting the rolls 12-15 to rotate substantially freely relative to the cartridges 36, 37 so that the supply friction, supply and control are substantially independent of the cartridges 36, 37.

The rolls 12-15 can be substantially similar in construction to one another. For example, referring to FIGS. 7-9, each roll 12-15 can include a spool 18 that, in the illustrated embodiment, can be substantially cylindrical with a first open end 20 and a second open end 22. Each spool 18 is generally hollow, with a plurality of circumferentially spaced, radially inwardly projecting ribs 30 extending axially within the interior of the spool 18. The axial ends of the ribs 30 terminate short of the first and second open ends 20, 22 so that at each of the open ends 20, 22, a gap 32 exists between the axial ends of the ribs 30 and the terminal ends of the spool 18. Further information on the construction of the spool 18 can be found in U.S. Pat. No. 6,726,144 which is incorporated herein by reference in its entirety. However, the spools 18 used in each roll 12-15 need not be identical to one another.

The ribbon-like material 16, 17 is initially wound onto the spool 18 of the respective roll 12, 13, and as the ribbon-like material 16, 17 is used, it is wound onto the take-up spool of the roll 14, 15 in known manner.

Each spool 18 can also include a roll cap, generally referenced by numeral 34, that is mounted at one of the open ends, for example the first open end 20, of the spool 18. Each roll cap 34 is designed to mount the respective roll 12-15 to the respective cartridge 36, 37. Each roll cap 34 can be removably mounted to the respective spool 18 in a manner that allows the respective roll cap 34 to be removed from the respective spool 18 at the end of use of the ribbon supply 10, 11 without destroying the roll cap 34 or the spool 18, thereby allowing individual re-use of the rolls caps 34 and the spools 18. In another embodiment, the roll caps 34 can be designed to the permanently attached to the respective spool 18 so that the rolls caps 34 cannot be removed without destroying either the roll caps 34 or the spools 18, although the roll caps 34 and spool 18 combinations can be re-used.

The roll cap 34 can have any configuration suitable for achieving the functions of the roll cap 34 described herein. The roll caps 34 used on the rolls 12-15 can be the same or substantially the same. In another embodiment, the roll caps 34 can be different from one another depending upon the type of roll 12-15. For example, as discussed further below, different roll cap geometries and/or sizes can be provided based on the type of ribbon supply the roll cap is used with. For example, in one embodiment discussed further below with respect to FIGS. 3A-C, 4A-D, 5A-D and 6A-D, there can be three roll caps 34*a-c* having different sizes and/or geometries, namely a roll cap 34*a* with a first size and/or geometry that is designed for use with a print ribbon supply spool, a common roll cap 34*b* with a second size and/or geometry designed for use with a take-up spool, and a roll cap 34*c* with a third size and/or geometry that is designed for use with a retransfer film spool. Having different roll cap sizes and/or geometries facilitates proper loading of the particular supply as the user cannot, for example, install a print ribbon supply into the cartridge 37 intended to receive a retransfer film supply. In one embodiment, one or more of the roll caps 34*a-c* can include additional features such as, but not limited to, a radio-frequency identification (RFID) tag. For example, in one embodiment, the roll cap 34*b* that is designed for use with a take-up spool can include an RFID tag that facilitates communication of information related to a supply to a card personalization machine. In one embodiment, one or more of the roll caps 34*a-c* can be integrally formed with the corresponding roll 12-15. For example, in one embodiment, the roll cap 34*a* can be integrally formed with a print ribbon supply spool such that the roll cap 34*a* and the print ribbon supply spool are a single piece, unitary construction.

Referring to FIGS. 1A and 1B, the cartridge 36 is configured to allow the rolls 12, 14 to be removably mounted thereon, with the cartridge 36 then being removably insertable into a card personalization machine for use of the ribbon-like material 16 (not visible in FIGS. 1A and 1B). The cartridge 36 includes a mounting location 38 for the ribbon supply roll 12 and a mounting location 40 for the ribbon take-up roll 14. In the illustrated example, the cartridge 36 can also include a pair of guide pins/rollers 44 which helps to guide the ribbon-like material 16 as it travels from the roll 12 to the roll 14.

Likewise, referring to FIGS. 2A and 2B, the cartridge 37 is configured to allow the rolls 13, 15 to be removably mounted thereon, with the cartridge 37 then being removably insertable into the card personalization machine 150 for use of the ribbon-like material 17 (not visible in FIGS. 2A and 2B). The cartridge 37 includes a mounting location 39 for the ribbon supply roll 13 and a mounting location 41 for the ribbon take-up roll 15. In the illustrated example, the cartridge 37 can also include a plurality of guide pins/rollers 45 which helps to guide the ribbon-like material 17 as it travels from the roll 13 to the roll 15.

The cartridges 36, 37 are generally similar in overall construction and operation. For example, the illustrated cartridges 36, 37 are devoid of the standard spindles on which spools of a ribbon supply are traditionally mounted as disclosed in U.S. Pat. Nos. 6,997,629 and 7,434,728. Instead, each of the rolls 12-15 is mounted on the respective cartridge 36, 37 without using spindles on the cartridge 36, 37. The cartridges 36, 37 are configured to hold the rolls 12-15 steady and prevent rotation and other movement of the rolls 12-15 once the rolls 12-15 are mounted at the respective mounting locations 38-41 and prior to the cartridges 36, 37 being installed in the card personalization machine 150. In particular, each of the mounting locations 38-41 of the cartridges 36, 37 includes a retaining lip 46 and a biasing arm 48 that engages against the roll cap 34 of the respective roll 12-15 to bias the roll cap 34 against the retaining lip 46 to hold the respective roll 12-15 in place via friction. Further details on the construction and operation of each mounting location 38-41 will be described below.

Referring to FIGS. 3A-C, 4A-D, 5A-D and 6A-D, details of the roll caps 34*a-c* will be described. In one embodiment, the roll caps 34*a-c* can have different geometries and/or sizes based on the type of ribbon supply the roll cap 34*a-c* is used with. For example, in one embodiment, there can be three roll cap sizes and/or geometries, namely the roll cap 34*a* that is designed for use with the spool 18 of the supply roll 12 and that has a first size and/or geometry, the roll cap 34*b* that is designed for use with the spool 18 of the take-up rolls 14, 15 and that has a second size and/or geometry that is different than the size/geometry of the roll cap 34*a,* and the roll cap 34*c* that is designed for use with the spool 18 of the roll 13 and that has a third size and/or geometry that is different than the size/geometry of the roll cap 34*a* and of the roll cap 34*b*. Having different roll cap sizes and/or geometries facilitates proper loading of the particular supply roll 12-15 as the user cannot, for example, install the ribbon supply 12, 14 onto the cartridge 37 that is intended to receive the ribbon supply 13, 15, and the ribbon supply 13, 15 cannot be installed onto the cartridge 36 that is intended to receive the ribbon supply 12, 14. In another embodiment, the roll caps 34*a-c* for each of the rolls 12-15 can have the same construction.

The roll caps 34*a-c* can have any configuration suitable for achieving the functions of the roll caps 34*a-c* described herein. Each of the rolls caps 34*a-c* have a generally common overall construction where each roll cap 34*a-c* is generally cylindrical and includes a cap body 50 having a first end 52, a second end 54 opposite the first end 52, and a central axis A-A extending from the first end 52 to the second end 54. For each roll cap 34*a-c,* a first flange 56 and a second flange 58 are formed on the cap body 50. The first flange 56 is circumferentially continuous, and is circular in shape with a first diameter. The second flange 58 is also circumferentially continuous, and is also circular in shape with a second diameter. However, in the roll cap 34*a,* the first diameter is greater than the second diameter. In the roll cap 34*b,* the first diameter is less than the second diameter. In the roll cap 34*c,* the first diameter is approximately equal to or slightly less than the second diameter. In one embodiment, the second flange 58 of the roll caps 34*a-c* can have different diameters to prevent, for example, improper loading of the particular supply roll 12-15. For example, in one embodiment, a ribbon supply roll can include the roll cap 34*a* mounted to the spool 18 of the supply roll 12 and having the second flange 58 with a first diameter, the ribbon supply roll further including the roll cap 34*b* mounted to the spool 18 of the take-up rolls 14, 15 and with the second flange 58 having a second diameter that is different than the first diameter.

For each roll cap 34*a-c,* the cap body 50 further includes a neck 60 that extends from the first end 52 toward the second end 54, for example to the first flange 56, and that is sized to fit into the gap 32 at the end 20 of the respective spool 18. The neck 60 is generally cylindrical and can fit into the end 20 with a tight interference fit between the exterior surface of the neck 60 and the interior surface of the respective spool 18 so that the respective roll cap 34*a-c* cannot rotate relative to the respective spool 18 and the roll cap 34*a-c* is secured to its respective spool 18. The diameter of the exterior surface of the neck 60 is less than the diameter of the first flange 56 so that the first flange 56 will act as a stop limiting the insertion depth of the roll cap 34*a-c* into the respective spool 18. In another embodiment, the neck 60 can include a lock feature 61, such as a circumferential lip or barb, that can engage with a feature on the inside of the respective spool 18 to help lock the roll cap 34*a-c* in place.

The first flange 56 and the second flange 58 define a channel 62 therebetween which is formed by the exterior surface of the cap body 50. The exterior surface that defines the channel 62 has a diameter that is less than the diameter of the first flange 56, and less than the diameter of the second flange 58. For the roll cap 34*a,* the diameter of the channel 62 is less than the diameter of the neck 60. For the roll cap 34*b,* the diameter of the channel 62 is greater than the diameter of the neck 60. For the roll cap 34*c,* the diameter of the channel 62 is less than the diameter of the neck 60.

Figure 4A:
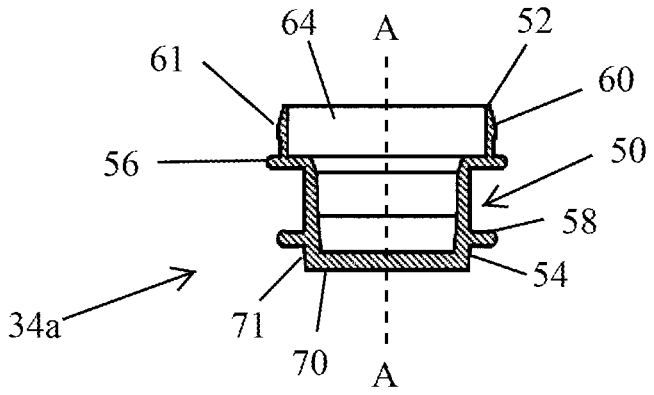
Figure 5A:
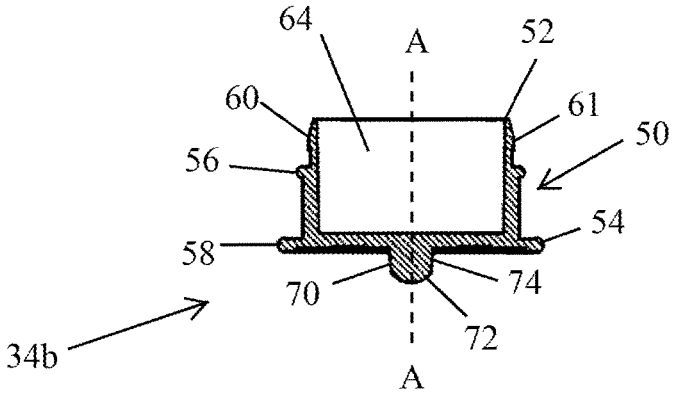
Figure 6A:
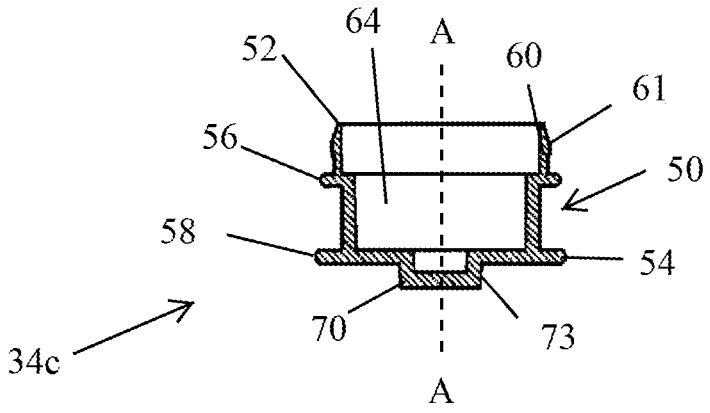
Figure 6D:
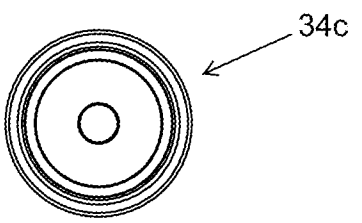
Figure 6B:
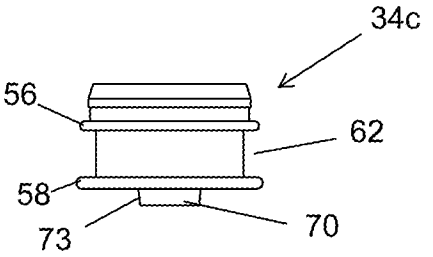
Figure 6C:
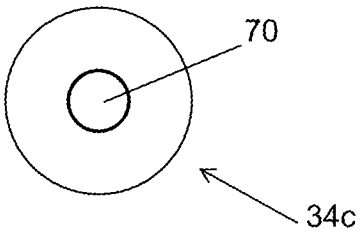
Figure 5D:
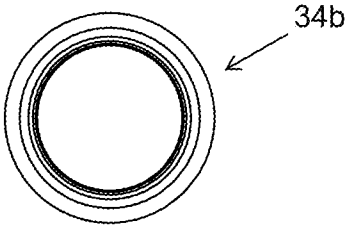
Figure 5B:
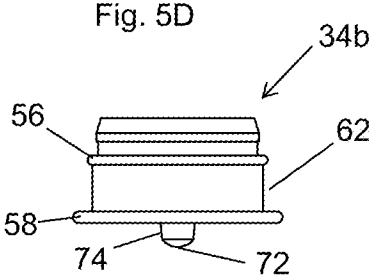
Figure 5C:
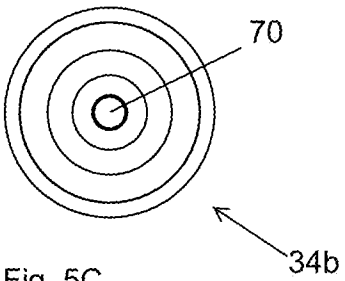
Figure 4D:
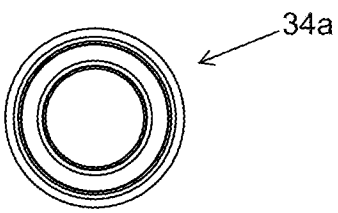
Figure 4B:
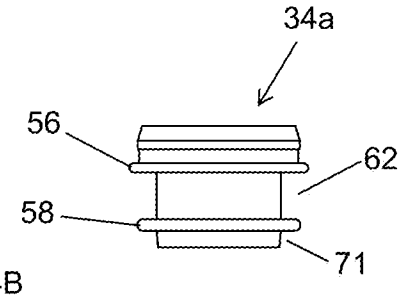
Figure 4C:
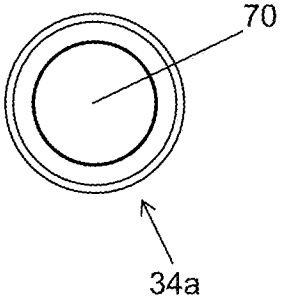

For each roll cap 34*a-c,* the cap body 50 can be configured so that it closes the open end 20 of the respective spool 18. However, each cap body 50 can be generally hollow as seen in FIGS. 4A, 5A and 6A so that each cap body 50 forms a region 64 that extends from the first end 52 toward the second end 54, and that in use receives an of a spindle 154 on the card personalization machine 150 as will be described below with respect to FIG. 11.

For the roll cap 34*a,* the second flange 58 is disposed at the second end 54, and has a diameter that is larger than the diameter of the exterior surface that defines the channel 62. For the roll cap 34*b,* the second flange 58 is disposed at the second end 54, and has a diameter that is larger than the diameter of the exterior surface that defines the channel 62. For the roll cap 34*c,* the second flange 58 is disposed at the second end 54, and has a diameter that is larger than the diameter of the exterior surface that defines the channel 62.

Each roll cap 34*a-c* further includes a protrusion 70 that projects from the second end 54 of the cap body 50 in a direction away from the first end 52. For each roll cap 34*a-c,* the protrusion 70 is centrally located at the second end 54 so that the central axis A-A extends through the center of the protrusion 70. The protrusions 70 of the roll caps 34*a-c* form loading features to prevent loading of the incorrect rolls 12-15 in the incorrect mounting locations 38-41. In addition, the tip ends of the protrusions 70 form relatively small, central contact points that contact their respective cartridges 36, 37 with a small surface area to minimize contact with the cartridge 36, 37. The protrusions 70 can have any configuration(s) suitable for achieving these functions.

In the case of the roll cap 34*a,* the protrusion 70 is illustrated as being generally circular in shape and having a diameter that is approximately equal to the diameter of the surface that defines the channel 62. However, the protrusion 70 has an angled or tapered side wall 71 that continuously tapers (i.e. reduces in diameter) from its point of connection at the second end 54 to its tip end. In one embodiment, the protrusion 70 of the roll cap 34*a* can have a diameter of about 25 mm and have a height measured from the second end 54 to its tip end of from about 1.0 to about 10 mm.

In the case of the roll cap 34*b,* the protrusion 70 is illustrated as being generally cylindrical or in the shape of a conical frustum, and has a tip end 72 and an angled or tapered sidewall 74 that continuously tapers (i.e. reduces in diameter) from its point of connection at the second end 54 to the tip end 72. In some embodiments, the tip end 72 can be convexly curved in a direction away from the first end 52 so that the tip end 72 is rounded outwardly. In one embodiment, the protrusion 70 of the roll cap 34*b* can have a diameter of about 6 mm and have a height measured from the second end 54 to the tip end 72 of from about 1.0 to about 10 mm.

In the case of the roll cap 34*c*, the protrusion 70 is illustrated as being generally circular in shape and having a diameter that is less than the diameter of the protrusion 70 of the roll cap 34*a*, and greater than the diameter of the protrusion 70 of the roll cap 34*b*. The protrusion 70 also has an angled or tapered side wall 73 that continuously tapers (i.e. reduces in diameter) from its point of connection at the second end 54 to its tip end. In one embodiment, the protrusion 70 of the roll cap 34*c* can have a diameter of about 11 mm and have a height measured from the second end 54 to its tip end of from about 1.0 to about 10 mm.

Returning to FIGS. 1A and 1B, the mounting locations 38, 40 of the cartridge 36 include an entrance/exit 80*a*, 80*b*, respectively, through which the ends of the rolls 12, 14 containing the roll caps 34*a*, 34*b* are inserted/removed. In this example, the entrance/exit 80*a* faces in a first direction, for example toward one of the end edges of the cartridge 36, while the entrance/exit 80*b* faces in a second, different direction, for example toward a side edge of the cartridge 36.

With reference to FIGS. 2A and 2B, the mounting locations 39, 41 of the cartridge 37 include an entrance/exit 80*c*, 80*d*, respectively, through which the ends of the rolls 13, 15 containing the roll caps 34*b*, 34*c* are inserted/removed. In this example, the entrance/exit 80*c* faces in a first direction, for example toward one of the end edges of the cartridge 37, while the entrance/exit 80*d* faces in a second, different direction, for example toward a side edge of the cartridge 37.

Each mounting location 38-41 further includes a slot/channel 86 that leads up to the respective entrance/exit 80*a*-*d*. The slot/channel 86 is sized and configured to receive the protrusion 70 on the respective roll cap 34*a*-*c* when the rolls 12-15 are slid into and from the mounting locations 38-41. For example, with reference to FIGS. 1A and 1B, the slot/channel 86 of the mounting location 38 is sized to receive the protrusion 70 of the roll cap 34*a*, while the slot/channel 86 of the mounting location 40 is sized to receive the protrusion 70 of the roll cap 34*b*. Likewise, with reference to FIGS. 2A and 2B, the slot/channel 86 of the mounting location 39 is sized to receive the protrusion 70 of the roll cap 34*c*, while the slot/channel 86 of the mounting location 41 is sized to receive the protrusion 70 of the roll cap 34*b*.

Further details of the mounting locations 38-41 and their interaction with the rolls caps 34*a*-*c* will be described with reference to FIGS. 7-10 and 10A. To simplify the description and to provide an illustrative example, FIGS. 7-10 and 10A illustrate details of the mounting location 40 for the take-up roll 14 having the roll cap 34*b* attached to the end of the spool 18 thereof. The cartridge 36 is only partially illustrated in FIGS. 7-10 and 10A. However, it is to be realized that the other mounting locations 38, 39 and 41 are similar in construction, operation, and interaction with the other rolls caps 34*a*, 34*c* as the mounting location 40.

An upper surface 82 of the cartridge 36 forms a guide surface on which a bottom surface of the second end 54 of the cap body 50 can slide when installing the roll 14 into the mounting location 40 and when removing the roll 14 from the mounting location 40. The slot/channel 86 receives the protrusion 70 on the roll cap 34*b*. As the roll 14 is slid into the mounting location 48, the second flange 58 slides underneath the retaining lip 46. At the same time, the biasing arm 48 engages against the second end 54 of the roll cap 34*b* which pushes the biasing arm 48 downward against the biasing force of the arm 48. The biasing arm 48 in turn applies a biasing force on the roll cap 34*b*, biasing the roll cap 34*b*, and the entire roll 14, in a direction away from the cartridge 36 so that the second flange 58 is held against the lip 46. In one embodiment, each biasing arm 48 can optionally include a detent 88 that receives the tip end of the protrusion 70 when the roll 14 is fully installed on the cartridge 36.

Referring to FIGS. 10 and 10A along with FIGS. 7-9, the retaining lip 46 is continuous from a first end 110*a* to a second end 110*b*. The area between the ends 110*a*, 110*b* that faces the entrance/exit 80*b* is open to allow entry/exit of the cap body 50. The ends 110*a*, 110*b* each include a sloped ramp surface 112 which engages with the second flange 58 when the roll 14 is being mounted to force the second flange 58 underneath the retaining lip 46.

Referring to FIGS. 8 and 9, the biasing arm 48 is configured to engage the second end 54 of the cap body 50 and apply a force to the cap body 50 to bias the second flange 58 against the underside of the retaining lip 46. The biasing arm 48 can be integrally formed with the cartridge 36 or it can be formed separately from but suitably attached to the cartridge 36. The biasing arm 48 is cantilever mounted at one end 114 thereof to the cartridge 36 with the biasing arm 48 being able to flex relative to the cartridge 36 at the end 114 to apply the biasing force. In an embodiment, a spring can be mounted to the cartridge 36 that acts against the biasing arm 48 to provide the biasing force for, or to supplement the biasing force of, the biasing arm 48. As seen in FIG. 7, the biasing arm 48 includes a slot/channel 116 that is aligned with the slot/channel 86 for receiving the protrusion 70. In one embodiment, the slot/channel 116 can intersect the detent 88 formed in the biasing arm 48 that receives the tip end 72 of the protrusion 70 when the roll 14 is fully installed on the mounting location 40 of the cartridge 36 as seen in FIG. 9.

In operation, the roll 14 is positioned in the entrance/exit 80*b* with the protrusion 70 in the channel 86 and the bottom surface of the cap body 50 sliding on the surface 82 of the entrance/exit 80*b*. The roll 14 is then slid into the mounting location 40 through the open end of the entrance/exit 80*b* between the ends 110*a*, 110*b* of the retaining lip 46. As the roll 14 is slid into position, the sloped ramp surfaces 112 engage with the second flange 58 forcing the second flange 58 to slide underneath the retaining lip 46. See FIG. 8. In addition, the protrusion 70 slides into the channel 116 of the biasing arm 48. As the roll 14 continues to be slid into position, the protrusion 70 forces the biasing arm 48 downward with the biasing arm 48 applying a corresponding upward biasing force to the cap body 50 and the roll 14. Insertion continues until the protrusion 70 snaps into position in the detent 88. See FIG. 9. At this position, the biasing arm 48 is applying an upward force to the cap body 50 and to the roll 14, thereby forcing the second flange 58 into engagement against the inner surface of the retaining lip 46. As a result, the cap body 50 of the roll 14 is frictionally held between the retaining lip 46 and the biasing arm 48, with the friction holding the roll 14 in place and preventing rotation and other movements of the roll 14. The other rolls 12-13 and 15 are mounted into the respective mounting locations 38-39 and 41 in a similar manner.

During use of the roll 14 (and the other rolls 12, 13 and 15) in the card personalization machine, the frictional engagement between the second flange 58 and the retaining lip 46 is released. Once released, the only frictional engagement between the rolls 12-15 and the cartridges 36, 37 is the minimal engagement between the tip ends of the protrusions 70 and the biasing arms 48. As a result, the rolls 12-15 are able to rotate with minimal friction applied thereto, allowing better control of winding and unwinding tension by the card personalization machine.

Referring to FIG. 11 along with FIGS. 12-14, an example of how the frictional engagement between the second flange 58 and the retaining lip 46 can be released is illustrated with respect to the roll 14. A similar release frictional engagement technique can be employed with respect to the rolls 12, 13 and 15 as well. In this example, the cartridge 36 with the roll 14 previously mounted thereon is illustrated as being mounted within the card personalization machine 150. The frictional engagement is automatically released when the cartridges 36, 37 are installed into the card personalization machine 150 through engagement between suitable frictional engagement release features on the card personalization machine 150 and the rolls 12-15.

For example, the machine 150 includes mounting spindles 154. In the illustrated embodiment, the mounting spindles 154 include a wall 152 and a projecting portion extending from the wall 152. The machine 150 includes one mounting spindle 154 for each roll 12-15. One or more of the spindles 154 can be rotatably driven by suitable drive mechanisms (not shown) known in card personalization machines, for example by stepper motors or the like. The spindles 154 are configured to engage with the ribs 30 in the spools 18 (see FIG. 7) such that rotation of the spindles 154 causes the respective spools 18 to rotate to either unwind or wind the ribbon-like material 16, 17. Each spindle 154 has a length that is sufficient to extend through the majority of the length of the rolls 12-15. In addition, the ends 22 of the spools 18 become engaged with the wall 152, for example plates 156 on the wall 152, which pushes the rolls 12-15 away from the wall 152 when the cartridges 36, 37 are fully installed so that the rolls 12-15 are forced to a seated position relative to the cartridges 36, 37 against the biasing force of the biasing arms 48. At the seated position, the second flange 58 is spaced away from, and is no longer engaged with, the retaining lip 46, as illustrated in FIG. 11, which removes the frictional engagement force between the second flanges 58 and the retaining lips 46.

When the cartridges 36, 37 are removed from the machine 150, the biasing force of the biasing arms 48 again forces the second flanges 58 against the retaining lips 46. The rolls 12-15 can then be removed from the cartridges 36, 37 by sliding the rolls 12-15 out from their respective mounting locations 38-41 opposite of the way that the rolls 12-15 were installed. New rolls 12-15 can then be mounted on the cartridges 36, 37.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A roll cap that is mountable at an end of a spool of a roll of a ribbon supply, comprising:

a cap body having a first end, a second end opposite the first end, and a central axis extending from the first end to the second end;

a neck that extends from the first end toward the second end and that is sized to fit into the end of the spool;

a first flange formed on the cap body at an end of the neck, the first flange is positioned between the neck and the second end;

a second flange formed on the cap body at a position so that the first flange is between the neck and the second flange;

the first flange and the second flange define a channel therebetween; and a protrusion projecting from the second end of the cap body in a direction away from the first end, and the protrusion is centrally located on the second end with the central axis extending through the center of the protrusion.

2. The roll cap of claim 1, wherein the cap body is generally cylindrical, the first flange is circumferentially continuous and has a first diameter, and the second flange is circumferentially continuous and has a second diameter that is greater than or less than the first diameter.

3. The roll cap of claim 1, wherein the second flange is disposed at the second end of the cap body.

4. The roll cap of claim 1, wherein the protrusion has a tip end, and the tip end is convexly curved in a direction away from the first end.

5. The roll cap of claim 2, wherein the neck is generally cylindrical, and the neck has a diameter that is less than the first diameter of the first flange.

6. A ribbon supply, comprising:

a ribbon supply roll and a ribbon take-up roll, each of the ribbon supply roll and the ribbon take-up roll has a spool with a first end and a second end;

a roll cap mounted at either the first end or the second end of at least one of the spools, the roll cap includes:

a cap body having a first end, a second end opposite the first end, and a central axis extending from the first end to the second end;

a neck that extends from the first end toward the second end and that is sized to fit into first end or the second end of the at least one spool;

a first flange formed on the cap body at an end of the neck, the first flange is positioned between the neck and the second end;

a second flange formed on the cap body at a position so that the first flange is between the neck and the second flange;

the first flange and the second flange defined a channel therebetween; and a protrusion projecting from the second end of the cap body in a direction away from the first end, and the protrusion is located on the second end so that the central axis extends through the protrusion.

7. The ribbon supply of claim 6, wherein the cap body is mounted at the first end of the spool of the ribbon supply roll or the cap body is mounted at the first end of the spool of the ribbon take-up roll.

8. The ribbon supply of claim 6, wherein the spool of the ribbon supply roll includes a ribbon wound thereon, and an end of the ribbon is connected to the spool of the ribbon take-up roll.

9. The ribbon supply of claim 8, wherein the ribbon is a print ribbon or a retransfer film.

10. A method of removably mounting a ribbon supply on a removable cartridge of a card personalization machine, the ribbon supply including a ribbon supply roll and a ribbon take-up roll each of which has a spool with a longitudinal axis, the method comprising:

installing each of the ribbon supply roll and the ribbon take-up roll at a respective mounting location defined on the removable cartridge;

installing includes sliding each of the ribbon supply roll and the ribbon take-up roll into the respective mounting location in a direction that is perpendicular to the longitudinal axis of the spool via an entrance/exit defined on the removable cartridge; and when each of the ribbon supply roll and the ribbon take-up roll are installed at the respective mounting location, generating a releasable friction between each of the ribbon supply roll and the ribbon take-up roll to prevent rotation of the respective spool about the longitudinal axis.

11. The method of claim 10, further comprising attaching a roll cap to the spool of each of the ribbon supply roll and the ribbon take-up roll, and generating the releasable friction includes generating the releasable friction between each of the roll caps and the removable cartridge.

12. The method of claim 11, further comprising resiliently biasing each of the ribbon supply roll and the ribbon take-up roll in a direction parallel to the longitudinal axis and away from the removable cartridge when the ribbon supply roll and the ribbon take-up roll are mounted at their respective mounting locations.

13. The method of claim 12, wherein resiliently biasing each of the ribbon supply roll and the ribbon take-up roll comprises applying a resilient biasing force to each of the roll caps.

14. A ribbon supply assembly comprising:

a removable cartridge of a card personalization machine, the removable cartridge defining a first mounting location that is configured for receiving a ribbon supply roll and a second mounting location that is configured for receiving a ribbon take-up roll, each of the first and second mounting locations is devoid of a spindle;

the ribbon supply roll mounted at the first mounting location and the ribbon take-up roll mounted at the second mounting location, each of the ribbon supply roll and the ribbon take-up roll includes a spool having a longitudinal axis;

a releasable friction between the ribbon supply roll and the removable cartridge at the first mounting location, and a releasable friction between the ribbon take-up roll and the removable cartridge at the second mounting location, to prevent rotation of the respective spool about the longitudinal axis.

15. The ribbon supply assembly of claim 14, wherein each of the ribbon supply roll and the ribbon take-up roll includes a roll cap secured to an end of the spool thereof, and each of the roll caps is releasably frictionally engaged with the removable cartridge to generate the releasable friction.

16. The ribbon supply assembly of claim 15, wherein each of the ribbon supply roll and the ribbon take-up roll are resiliently biased in a direction parallel to the longitudinal axis and away from the removable cartridge.

17. The ribbon supply assembly of claim 16, further comprising resilient biasing forces acting on the roll caps of each of the ribbon supply roll and the ribbon take-up roll in the direction parallel to the longitudinal axis and away from the removable cartridge.

* * * * *